US007019644B2

(12) United States Patent
Barrie

(10) Patent No.: US 7,019,644 B2
(45) Date of Patent: Mar. 28, 2006

(54) MOBILE OBJECT MONITORING SYSTEM

(76) Inventor: Robert P. Barrie, 6 Sunflower La., Nashua, NH (US) 03063

( * ) Notice: Subject to any disclaimer, the term of this patent is extended or adjusted under 35 U.S.C. 154(b) by 376 days.

(21) Appl. No.: 10/357,682

(22) Filed: Feb. 4, 2003

(65) Prior Publication Data

US 2004/0150520 A1 Aug. 5, 2004

(51) Int. Cl.
*G08B 1/08* (2006.01)

(52) U.S. Cl. ..... 340/539.13; 340/825.49; 340/573.4; 348/152

(58) Field of Classification Search ..... 340/573.4, 340/539.13, 825.49, 505, 571, 572.1, 573.1, 340/825.36, 825.72; 348/143, 150, 152, 348/159

See application file for complete search history.

(56) References Cited

U.S. PATENT DOCUMENTS 3,665,448 A * 5/1972 McGlinchey et al. .... 340/568.1
5,786,746 A * 7/1998 Lombardo et al. ..... 340/286.07
5,793,290 A * 8/1998 Eagleson et al. ..... 340/573.4
5,844,601 A * 12/1998 McPheely et al. ..... 348/143
6,211,781 B1 * 4/2001 McDonald ..... 340/505
6,292,106 B1 * 9/2001 Solinsky et al. ..... 340/825.49

* cited by examiner

*Primary Examiner*—Anh V. La
(74) *Attorney, Agent, or Firm*—Joseph E. Funk

(57) ABSTRACT

A security monitoring system providing security for mobile objects in any location, including children in a dining and child entertainment facility. The location of each object or child in the facility is tracked using a transmitter attached to the object or child when it/they enter the facility, and a video image of each child is mapped to and displayed on a video display at a table to which the child's family or group is assigned. Any unauthorized attempt at removing a child from the facility, or at a child attempting to leave the facility without authorization, or unauthorized removal of a transmitter, or a transmitter ceasing to operate, causes notification to be given to appropriate personnel and entrance/exits are locked until the child is located. Ordering of food and drinks is done using touch screen technology on the video display at each table. The transmitters can also be used to control access to video games or specific play areas as specified by a parent or guardian. When playing video games or using play facilities for which there is an extra charge, the transmitters are used for authorizing access and for billing purposes. To map physical positions within the facility to positions on a video display, a transmitter is placed in various locations about the facility and the touch screen video display is used to map the physical positions with positions on the video display for different video cameras.

29 Claims, 7 Drawing Sheets

MOBILE OBJECT MONITORING SYSTEM

FIELD OF THE INVENTION

This invention relates to a security monitoring system and more particularly to a system for monitoring the location of, and providing security for, any mobile objects including small children.

BACKGROUND OF THE INVENTION

In the prior art a number of security and object location systems are taught. In U.S. Pat. No. 5,543,797 a monitoring system is described for monitoring the location of mobile objects in a structure. This monitoring system provides an R. F. transponder for each mobile object or person. A number of transceivers are position around the monitored structure to receive transmitted signals from the transponders. Each transponder periodically transmits a unique identification code that is received by one or more of the transceivers that are closest thereto. The transceivers measure the strength of the signals received from the transponders and forward this information to a central controller. The central controller knows that a transponder is located in an area around the particular transceiver that measures and indicates the highest signal strength. The central controller can transmit commands through the particular transceivers to selected transponders, including audible messages to a person having a transponder, via an earphone. However, this monitoring system can only indicate a general area in which a specific transponder is located. It cannot provide a fairly specific position at which a specific transponder is located.

U.S. Pat. No. 3,419,865 teaches an arrangement for continuously determining and displaying the location of a number of mobile police vehicles for the purpose of indicating their exact relative locations within a metropolitan area. Each police vehicle has a transceiver that periodically transmits an identification signal within an assigned time slot in a time division multiplexing arrangement. An identification signal is received by at least three stationary receivers, each having clocks synchronized to a central master clock. The physical position of a vehicle is reflected in the time difference that the identification signal transmitted from the vehicle is received at each receiver. This information is transmitted back to a central computer that calculates the position of the vehicle on a map relative to the position of the stationary receivers. This arrangement will not work in an environment of adjacent rooms where it is desired to locate transceivers in each room, because radio waves generated by a transceiver in one room will travel through the walls and be received by receivers in adjacent rooms.

U.S. Pat. No. 5,512,879 teaches apparatus for preventing infant mix ups and kidnappings in hospitals. A miniature electronic security tag is affixed to the ankle of a newborn infant. Periodically, the tag transmits a unique encoded identity signal that is received by strategically placed radio receivers within a hospital. Attempts to remove a tag are detected and transmitted to the receivers. A central computer continuously determines the identity and location of each tagged infant in the hospital. In the event that an unauthorized person attempts to leave the hospital or a smaller monitored area with an infant, or if a tag is removed, an alarm is sounded. However, this monitoring apparatus only detects if an infant having a security tag is taken through a doorway equipped with a monitor receiver. It does not indicate the location of an infant within a larger area.

Thus, there is a need in the prior art for a security monitoring system that monitors the exact location of, and providing security for, mobile objects including children.

SUMMARY OF THE INVENTION

The foregoing need in the prior art is satisfied by the present invention. A security monitoring system is disclosed which monitors the location of, and provides security for, mobile objects including children and adults. A building having many rooms has a plurality of ultrasonic receivers and video cameras in each room. Each mobile object has an omni-directional ultrasonic transceiver that periodically transmits a distinctive encoded ultrasonic signal that is received by at least three ultrasonic receivers in the room in which the mobile object is located. The signals received by the plurality of ultrasonic receivers in each room are processed by a sensor processor associated with the ultrasonic receivers in each room using the propagation delays that the ultrasonic signal arrives at the different receivers in the room to triangulate and locate the exact position of the mobile object in the room. In this manner the location of each ultrasonic transceiver and its associated mobile object are always known and are stored in the computer. Examples of use of the invention are to keep track of prisoners in a penal institution, to keep track of patients and personnel in a care facility such as a mental or other type of hospital, and to keep track of children in a play facility. It is the latter use that is described herein.

There is a plurality of conventional security video cameras in each room, and each camera is used to visually monitor an area in the room in which the camera is located. A zoom function may be accomplished by electronically expanding a portion of the video output from a camera. In this manner the same original picture from a video camera may be used to create zoom pictures for a number of children in the view area of the camera.

To provide security services the central computer is programmed with information indicating what rooms in the building each mobile object is authorized to enter. If a mobile object attempts to enter an unauthorized room, an access door may be locked or kept locked, an alarm may be sounded at the site of the mobile object and/or at the central computer site, and a camera may be zoomed on the mobile object that caused the alarm to be sounded. The video signal from any selected camera may also be recorded. To implement such access control, turnstile gates and other access limiting devices may also be used, instead of a locked door, so that a child authorized to enter a certain area cannot give access to that area to a child that is not permitted access thereto. Alternatively, a centrally located attendant that has a video view of the entrance to each room may control the opening of the door or gate to each room after a transceiver worn by a child is sensed and checked.

The novel arrangement described above can advantageously be used to monitor and locate the exact position of children in a combined dining and child entertainment facility where a family or other group goes to eat and play, and the young children get to securely play in play areas. A family enters such a restaurant via one or more controlled entrances/exits where they are registered and assigned a table. The children each have a small ultrasonic transceiver attached to them that cannot easily be removed. Each transceiver is registered to each child during their visit.

At the assigned table there is one or more video stations that have graphical user interfaces with touch screen operation. A trackball, joystick, or computer mouse may also be used. There are playrooms that are typically located around the periphery of the dining and entertainment facility where the children can go to play while their parents sit at the assigned table. Within each room, including playrooms, dining room, lobby and bathrooms there are multiple ultrasonic receivers that receive the ultrasonic signals from each child's transceiver that is located in the room. The received signals from each room are fed to sensor processor that processes the propagation delays from all transceivers to their surrounding ultrasonic receivers to triangulate the position of each transceiver in each room and sends the location information to the central computer. In this manner the exact location of every child in the dining and entertainment facility is always known. If a child attempts to leave the dining and entertainment facility on their own, or an unauthorized attempt is made to take them out of the dining and entertainment facility via an entrance/exit this is detected, or a transceiver is removed in an unauthorized manner, or a transceiver ceases its periodic transmission, an alarm is sounded and the entrance/exit is locked until the matter is resolved.

At the table the parents may utilize the touch screen operation on a video station at the table to view the food menu, place food orders, and to view their children at play. To view their child a parent presses the touch screen at an appropriate spot. Responsive thereto the central computer looks up the present physical location of the ultrasonic transceiver of the child or children assigned to the table in its memory. The computer then routes the video signal from the video camera in the field of view of which the child is presently located back to the table where the child's parents are sitting and the picture is displayed on the video station at the table. The parent that requested the picture may send another touch screen entry request to do a close up of the child. Responsive thereto the computer selects a portion of the same video signal and performs an electronic zoom, is well known in the video art, to create a close up picture of the child that is returned to the video station at the table. To perform this zoom function the central computer uses the stored location of the child to determine what portion of the camera video signal is to be used for the electronic zoom. When there is more than one child, and a viewing request is made for each child, the computer creates a split screen operation on the video station and routes the video signal or electronically zoomed video signal for each child to the video display at the table.

In addition, there is a loudspeaker mounted in each room and playroom that may be used by the management for paging or other purposes. Parents may also utilize the touch screen video station at their table, which is also equipped with a microphone/loudspeaker, to page a child or to send a brief oral message to a child who is being viewed on their video station. Preferably, the transceiver on each child may be equipped with the ability to give an audible page/buzzer signal to a child, and to receive and give a voice message from the child's assigned table to the child. The touch screen video stations may also be used to see facility personnel and orally communicate with them to place food and drink orders, and to communicate with the reception desk.

During installation and setup of the ultrasonic sensors and ultrasonic signal processing equipment, video cameras, and video stations a procedure is followed to correlate what is seen on the screens of the video stations with what the position of ultrasonic transmitters are within a room as determined by the ultrasonic signal processing equipment. This is accomplished by positioning an ultrasonic transmitter in specific locations within a room, such as in corners and at locations that appear on the edge of the video station screen and then touching the image of the transmitter on the video station screen. The system records the screen locations, as determined by the touch screen circuitry, and correlates that information with the output of the ultrasonic sensors and ultrasonic signal processing equipment. In actual operation a processor in the system interpolates position information of an ultrasonic transmitter with a screen location to know where a child wearing the transmitter is located to determine what video camera image is to be used to display an image of the child on a video station screen, and what portion of the overall image to blow up for a close up of a child.

DESCRIPTION OF THE DRAWINGS

The invention will be better understood upon reading the following detailed description in conjunction with the drawing in which.

DETAILED DESCRIPTION

Figure 1:
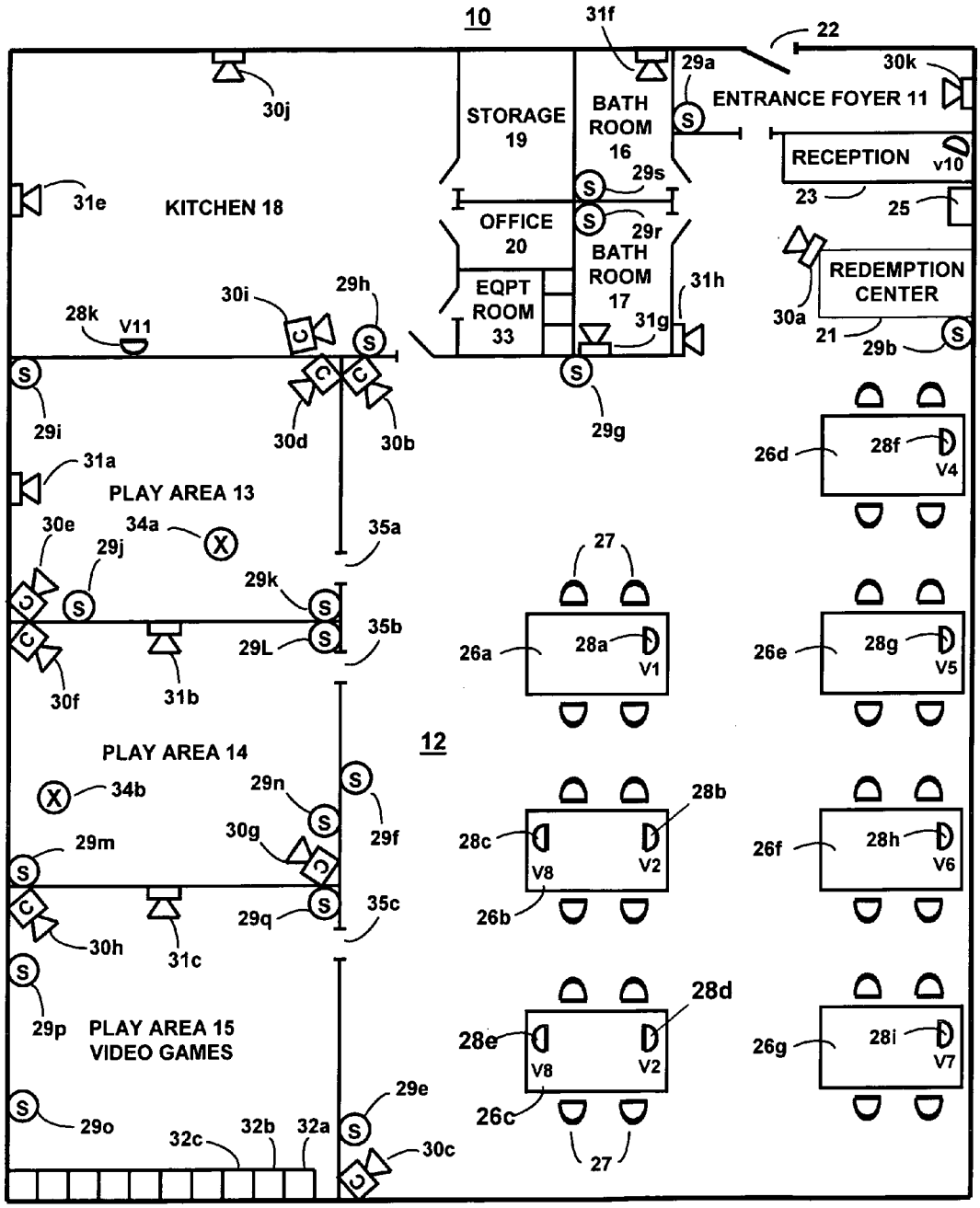
FIG. 1 shows a general floor plan of a dining and entertainment facility in accordance with the teaching of the preferred embodiment of the invention.

FIG. 1 shows a general floor plan of a dining and entertainment facility 10 utilizing the security monitoring equipment in accordance with the teaching of the preferred embodiment of the invention.

Dining and entertainment facility 10 is primarily for children and has play areas such as presently exist around the country. Examples are Burger King, McDonalds and Chuck-E-Cheese. Facility 10 has one or more exterior entrance/exit doors 22, an entrance foyer 11, a dining area 12, play areas 13, 14 & 15, bathrooms 16 and 17, a kitchen 18 where food and drink our prepared, a storage area 19, an office 20, and an equipment room 33 in which is located a central computer, recording, and video and audio switching equipment (not shown) which are used to implement the present invention.

Located throughout facility 10 are a plurality of ultrasonic sensors 29*a*–29*s* that are generally mounted high on a wall, a plurality of video cameras 30*a*–30*k* that are also generally mounted high on a wall, and touch screen video stations 28*a*–28*k* located on dining tables 26*a*–26*g*, at reception 23, in kitchen 18, and office 20. In addition, there is a speaker 31(*a*–*h*) located in all rooms including each of play areas 13, 14 & 15 for paging and other communication purposes. More specifically, speaker 31*a* is located in play area 13, speaker 31*b* is located in play area 14, speaker 31*c* is located in video game play area 15, speakers 31*d*&*h* are located in dining area 12, speaker 31*e* is located in kitchen 18, speaker 31*f* is located in bathroom 16 and speaker 31*g* is located in bathroom 17. Speakers 31*a*–31*h* are used to communicate short messages from parents to their children in the play areas and by personnel of facility 10 for general paging purposes. Alternatively, the transceivers attached to children may also be used to communicate with the children as a pager/buzzer or with voice messages. Most dining tables 26*a*–26*g* have only a single video station 28 located thereon, but some tables, such as tables 26*b* and 26*c*, have two video stations 28 located thereon. As shown, table 26*b* has video stations 28*b*&*c* located thereon, and table 26*c* has video stations 28*d*&*e* located thereon.

Dining and entertainment facility 10 is accessed by the public via entrance/exit door 22 which leads into entrance foyer 11. There are other emergency exit only doors (not shown) as may be required by municipal authorities. There may also be a door for deliveries and restricted access by employees only. There may be more than one public entrance/exit door, although only one such door is shown and described herein. A family or other group enters entrance foyer 11 and registers at reception desk 23. As part of the registration process each family or group's picture is taken at photo desk 25 and an ultrasonic transceiver 34 is attached to each child with each family or group. For the purpose of this description, it is assumed that there are two children and they each respectively have an omni-directional, ultrasonic transceiver 34*a* and 34*b* attached to them. It may be attached to a child's wrist, ankle or elsewhere. The ultrasonic transceivers 34*a*&*b* operate at the same frequency as ultrasonic receivers 29*a*–*r* that are described further in this description. For security purposes the transceivers 34*a*&*b* are attached to the children in a manner that a child or anyone else cannot readily remove the transceiver. In addition, if a transceiver 34 is removed from a child in an unauthorized manner an alarm signal is immediately sent to the central computer and security measures are immediately taken to locate the child and to assure that they do not leave dining and entertainment facility 10. Also, if an ultrasonic transceiver 34 on a child ceases transmitting its periodic signal, this is immediately detected by the central computer (not shown) in equipment room 33 and security measures are immediately taken to locate the child and to assure that they do not leave dining and entertainment facility 10. These measures include displaying at video station 28*j* at the front desk, a video station in office 20, and selected other video stations 28, the output of the video camera(s) 30 from which video images of the child were being obtained at the moment that a transceiver attached to the child ceases transmitting or is removed in an unauthorized manner.

The family or group is then assigned to one of tables 26*a*–26*g*. For the purpose of this description, it is assumed that they are assigned to table 26*b*. The identity of each child's ultrasonic transceiver 34(*a* or *b*) and table 26*b* that has been assigned to the family or group are input to a central computer (not shown) in equipment room 33 from video station 28*j* at reception desk 23. While all ultrasonic transceivers 34 operate at the same frequency, they each periodically generate a distinctive signal that is used in determining the location of each transceiver 34 within facility 10, but each periodic transmission is followed by other information indicating alarm conditions such as a transceiver attachment strap being cut or broken. More particularly, the system operates in a time division multiplex (TDM) manner wherein each child's transceiver 34 transmits its identification signal in a unique time slot assigned to each transceiver 34. There is no master clock to synchronize transceivers 34 with a clock in the central computer. Rather, a clock run by an oscillator in each transceiver 34 is set by the central computer just before the transceiver is attached to a child and the clock free runs until set again. The clock is accurate enough that while free running over several hours it maintains a close enough synchronization to a clock in the central computer and in a sensor processor associated with the ultrasonic sensors in each room so that each transceiver's periodic transmissions remain in their respective time slots.

As part of the registration process the children may be authorized to play video games in video game room 15. An automated system is used to implement access to video games. On initial registration at reception desk 23, or at any time thereafter, a child is authorized to play a given number of times (game credits) on the games in video game play area 15. This information and the fact that the child is authorized to enter game area 15 are stored in the central computer. A child's transceiver 34 is first used to gain access to video game play area 15 as previously described. A transceiver 34 is then used to play ones of video games 32. To do so a child passes their transceiver 34 before an ultrasonic sensor on each of games 32. This is sensed by the central computer and the particular game 32 is enabled to be played by the child, if the child is authorized to play the game 32 and they have remaining game credits. On the screen of the particular video game 32 the number of remaining game credits and the child's game winnings may be displayed. Each time a child plays a video game 32, their remaining number of game credits is decremented in a debit card type operation. At any time during a visit to facility 10, or upon leaving, a child may go to prize redemption center 21 and pick one or more prizes depending on the amount of their winnings at games 32.

Dining area 12 and play areas 13, 14 & 15 are accessed via a single entrance/exit gate 24 in entrance foyer 11 as shown herein, but more than controlled access may be provided. This restricted or controlled access, continuously monitored by personnel of facility 10 at reception desk 23, provides excellent security against a child attempting to walk out, or an unauthorized person attempting to remove a child from facility 10. When any person attempts to leave facility 10 with a child, the electronic photograph taken at photo center 25 upon registration is retrieved on the screen of video station 28*j* for comparison purposes. If the person attempting to leave facility 10 with a child is not the person shown in the family or group photograph, entrance/exit gate 24 will be locked and not be opened until the matter is satisfactorily resolved.

If there are members of the family or group assigned to table 26*b* who will be arriving after initial registration, their names are given to the personnel at reception desk 23. When the late arriving group or family member(s) enter and identify themselves to the reception personnel they stand in front of a video camera 30*k* in entrance foyer 11 and the reception personnel uses video station 28*j* to send their video picture to video stations 28*b*&*c* at table 26*b*. The reception personnel then communicate audibly with the group at table 26*b* for authorization to permit the late arriving person(s) to enter and join the group or family at table 26*b*.

Using touch screen video stations 28*b*&*c* the family or group peruses the food and drink menu by touching the area of the screen that requests the display of the menu. When a menu is displayed, dining and drink selections are made by touching the screen on either of the two video stations 28*b* and 28*c*. The menu may include pictures of the offerings, and may include a child menu and an adult menu. If there are questions about food or drink items, or requests for special preparation, an appropriate touch screen location may be touched to establish a video and voice connection with kitchen personnel as is described in detail further in this detailed description.

After all dining and drink selections are made, as displayed in an order column on the screen of video stations 28*b*&*c*, and including a current billing total, pressing an on-screen button entitled "Order" causes the order to be transmitted via the central computer (not shown) in equipment room 33 to be displayed on video station 28*k* in kitchen 18 along with the identity of table 26*b*. Kitchen personnel watch monitor 28*k* and prepare food and drinks to fulfill the order for tables 26*a–g*. After orders are prepared they can either be delivered to tables by facility personnel or, with self service operation, a visual and/or audio notice can be sent to video stations 28*b*&*c* at table 26*b* that someone come pick up the order. Additional food and drink orders may be placed at any time during the course of the visit to facility 10.

While waiting for a food and drink order to be delivered to table 26*b*, or for a notice to pick it up, the two children wearing ultrasonic transceivers 34*a*&*b* may remain at table 26*b*, may walk around dining area 12, play in any of play areas 13,14 and 15, or go to bathrooms 16 or 17. If a child remains at table 26*b* the periodic ultrasonic signal transmitted by their transceiver 34*a* or 34*b* is received by at least three of the ultrasonic receivers 29*b,c,d,e,f,g* positioned around the periphery of dining area 12 and is forwarded to a sensor processor (not shown) associated with each sensor. The sensor processor is described with reference to FIG. 2. The sensor processors measure the relative arrival times of the ultrasonic signals from transceivers 34*a* and 34*b* at receivers 29*b,c,d,e,f,g* to locate the exact position of these transceivers in dining area 12 in a manner well known in the art. While only two transceivers 34*a*&*b* are mentioned in this description for the sake of simplicity, it should be understood that there could be thirty or more children, each having an attached transceiver 34, inside dining and child entertainment facility 10. Video stations 28*a–i* may also be used to play video games stored therein or in the central computer. This is particularly useful for smaller children who are not allowed to roam around facility 10. Games, menus, pictures, etc, may all be accessed on video stations 28 with a windowing operation.

If a child goes to bathroom 16 or 17, their presence in the bathroom is detected respectively by sensor 29*s* or sensor 29*r* therein, but because there are no video cameras 30 in the bathrooms, no video signal of the interior of the bathroom is forwarded to video stations 28*b*&*c* at table 26*b* when a viewing request is made by the parent(s) using one of video stations 28*b*&*c*. Instead, a picture of the bathroom door is displayed on video stations 28*b*&*c* and a message is superimposed thereon indicating the child's name and the length of time the child has been in the bathroom. The system software can keep track of the time that a child has been in bathroom 16 or 17 and provide an indication of same to their parents or chaperones at table 26*b* so they may determine if too much time has elapsed indicating that the child may be sick or in other difficulty and they can go check on the child.

The presence of a child in play area 13 is detected by sensors 29*i,j*&*k*; their presence in play area 14 is detected by sensors 29*l,m*&*n*; and their presence in video game play area 15 is detected by sensors 29*o,p,q*. The sensor processors processes the signals received by the three sensors 29 in any of play areas 13, 14 and 15 or three sensors 29 in dining area 12 to triangulate and locate the exact position of the children wearing transceivers 34*a*&*b* in a manner well-known in the art. The position of each child in facility 10 is stored in the central computer and is updated very frequently. The stored child location information is used to establish a viewing connection between requesting ones of the tables and the rooms in which particular children are located. A page/buzzer signal or a voice communication may also be sent directly to a child's transceiver 34 from the video station at the table where the child's parent(s), guardian(s) or chaperone(s) are located, or from video station 28*j* at reception desk 23.

Entertainment in different ones of play areas 13, 15 and 15 may be chosen for given age groups. If it is decided to restrict access of certain children to particular play areas, electronically controlled doors, turnstile or other types of controlled access doors or gates 35 are added to the play areas 13, 14 and 15 that are controlled by ultrasonic sensors and the central computer. As previously mentioned a central attendant may also monitor and control access to play areas. Door 35*a* is added to play area 13, door 35*b* is added to play area 14, and door 35*c* is added to play area 15. At the time of registration at reception desk 23 the registration personnel would use video station 28*j* to input child age information that would restrict what play areas a child may enter. For example, a young child may be allowed to enter play areas 13 and 14, but not enter play area 15 wherein are located video games 32. When a young child wearing ultrasonic transceiver 34*a* approaches door or gate 35*a* to play area 13 the signal from their transceiver is detected by a sensor at the door or gate, not shown, and is compared with access privileges stored in the central computer. Access may also be checked and controlled by the central attendant using a video display of the child. When the central computer determines that the child is allowed access to play area 13, door or gate 35*a* opens. The same operation applies to play area 14. However, when the same young child wearing ultrasonic transceiver 34*a* approaches door or gate 35*c* to video game play area 15, the computer or attendant determines that the child is not allowed access to this play area and door or gate 35*c* remains closed. A turnstile type gate or other type of restricted access gate or door could be used that permits only a single child to enter at a time and thereby prevent a child having authorized entrance to a play area from letting in a child who does not have authorized access.

Older children who have been authorized access to video game play room 15 can enter and play the video games 32 therein based on their game play credits authorized on registration, or thereafter, and on the detection of their ultrasonic transceiver 34 by a sensor (not shown) at each particular video game 32, with verification by the central computer. If the child has game winnings he or she may redeem them for prizes at redemption center 21 at any time or when departing facility 10. When a child attempts to access a video game 32 their remaining game play credits and game winnings are displayed on the screen of the video game.

If a child walks into kitchen 18, where they should not be, their presence is detected by sensor 29*h* that returns a signal to the central computer (not shown) in equipment room 33 that immediately recognizes that no coded ultrasonic signals from ultrasonic transceivers 34 worn by children should be detected in kitchen 18. As a result the computer causes an audible alarm (not shown) to be given in kitchen 18 and kitchen employees or waiters/waitresses immediately locate the child and usher them from kitchen 18. The kitchen employees and waiters and waitresses may also be equipped with a transceiver 34 to give them access to kitchen 18 or any other rooms, such as storage room 19, office 20 and equipment room 33. In addition, the central computer in equipment room 33 routes the video signal from video cameras 30*i* and/or 30*j* in kitchen 18 to video station 28*j* at reception 23 where personnel may view the presence of the child in kitchen 18. Although not shown in FIG. 1 a video station 28 may also be placed in office 20 to which the central computer also routes the video signal from video cameras 30*i* and/or 30*j* and someone in that office may view the presence of the child in kitchen 18 when the above mentioned alarm is sounded. Video station 28*k* is also used to receive food and drink orders, and to visually and orally communicate with video stations 28 on ones of tables 26*a–g*, and to personnel at reception desk 23.

While the parents of the children wearing ultrasonic transceivers 34*a*&*b* are sitting at table 26*b* and their children are playing in the play rooms, the parents may view what the children are doing on video stations 28*b* and 28*c*. This is done by touching an appropriate place on the touch screen operation equipped video display of station 28*b* and/or 28*c*. This viewing request is transmitted to the central computer in equipment room 33. Responsive to the viewing request the computer first identifies the table 26*b* from which the request originated, looks up where the children from table 26*b* are presently located and operates a video switch (shown in FIG. 2 but not in FIG. 1) that routes video signals from a selected video camera in the play area(s) in which the two children are located to video stations 28*b* and/or 28*c* at table 26*b*. When there is more than one child, and a viewing request is made, the computer creates a split screen operation on video stations 28*b* and 28*c* and routes the video signal for each child to the video stations. Alternatively, two separate screens may be utilized and the parents may switch between the two screens.

For a specific example, when the parents at table 26*b* request to see their two children, the central computer has already detected ultrasonic transceiver 34*a* in play area 13 and ultrasonic transceiver 34*b* in play area 14. From the triangulated position of the two children the central computer knows that one child is in the viewing area of video camera 30*e* in play area 13 and sends that video signal to table 26*b*, and knows that the other child is in the viewing area of video camera 30*g* in play area 14 and sends that video signal to table 26*b*. Using the touch screen operation of video stations 28*b* or 28*c* the parents can also request a close up of the children. The computer responds to this request and locates where in the previously identified video picture the child is located. The computer then performs a well known electronic zoom function and selects a smaller portion of the original video signals and expands them to thereby provide close up, zoom pictures of the children via the video signal switching equipment (not shown) in equipment room 33 to video stations 28 *b*&*c* at table 26*b*.

A parent at table 26*b* may also audibly contact either or both their children. To accomplish this they touch an appropriate spot on either video station 28*b* or 28*c* at their assigned table 26*b* to request sending a page/buzzer signal to one or both of their child's transceivers 34*a* or 34*b*, or to establish a voice communication link with either or both transceivers 34*a* and/or 34*b*. To implement the page/buzzer operation low power radio frequency pager circuitry (not shown) located in equipment room 33, alike that used in pager systems that are well known in the art, is provided to send coded page signal to selected ones of transceivers 34 where it is recognized and operates a pager signal also in a manner well known in the pager art. To implement the voice message operation a low power transmitter (not shown) located in equipment room 33, also alike voice pagers that are well known in the art, is provided to send a coded address and voice message signal to selected ones of transceivers 34 where it is recognized and the voice message is played. In an alternative arrangement a short oral message can be sent to either or both of the child in playroom 13 via speaker 31*a*, and the child in playroom 14 via speaker 31*b*. For the alternative arrangement the central computer looks up play room 13 as the room in which the child wearing transceiver 34*a* is located, and play area 14 as the room in which the child wearing transceiver 34*b* is located and establishes an audio link between speaker 31*a* in playroom 13 and speaker 31*b* in playroom 14 and microphones located within video stations 28*b* and 28*b* at table 26*b*. A message is then presented on screen to the parents to commence speaking to the child. A parent has a predetermined amount of time, say five or seven seconds to speak. In this manner, for example, the children may be called back to table 26*b* for dinner.

When the family finishes their stay in dining and entertainment facility 10 they may access their bill by touching an appropriate spot on video stations 28*b* or 28*c*. They will then go to reception desk 23, pay their bill and have the ultrasonic transceivers removed from their children. Alternatively, located on each table 26 is a card swipe mechanism (not shown) for using credit or debit cards to pay bills. As part of the check out process the children may at that time redeem their un-redeemed game win credits for prizes at redemption center 21. Also as part of the check out process the personnel at reception desk 23 compare the photograph of the group or family taken on registration with the group leaving to assure that an unauthorized person or persons are not attempting to leave with a child or children. If this does happen exit gate 24 is locked and not opened, and the authorities may be called and/or the proper authorized persons paged to come to reception desk 23. The gate opening operation is designed so that a button must be held down by personnel at reception desk 23 the entire time the gate is unlocked. If the button is released the gate immediately re-locks. This prevents an unauthorized person from pushing the button and attempting to exit through gate 24 before it re-locks. In addition, the unlocking button function may be replaced by a keypad (not shown) and the personnel at the reception desk must enter a code to unlock exit gate 24. This operation would preclude an un-authorized person attempting to exit facility 10 with a child by jamming an exit release button. In addition, the un-authorized persons picture would be taken by a video camera.

Figure 2:
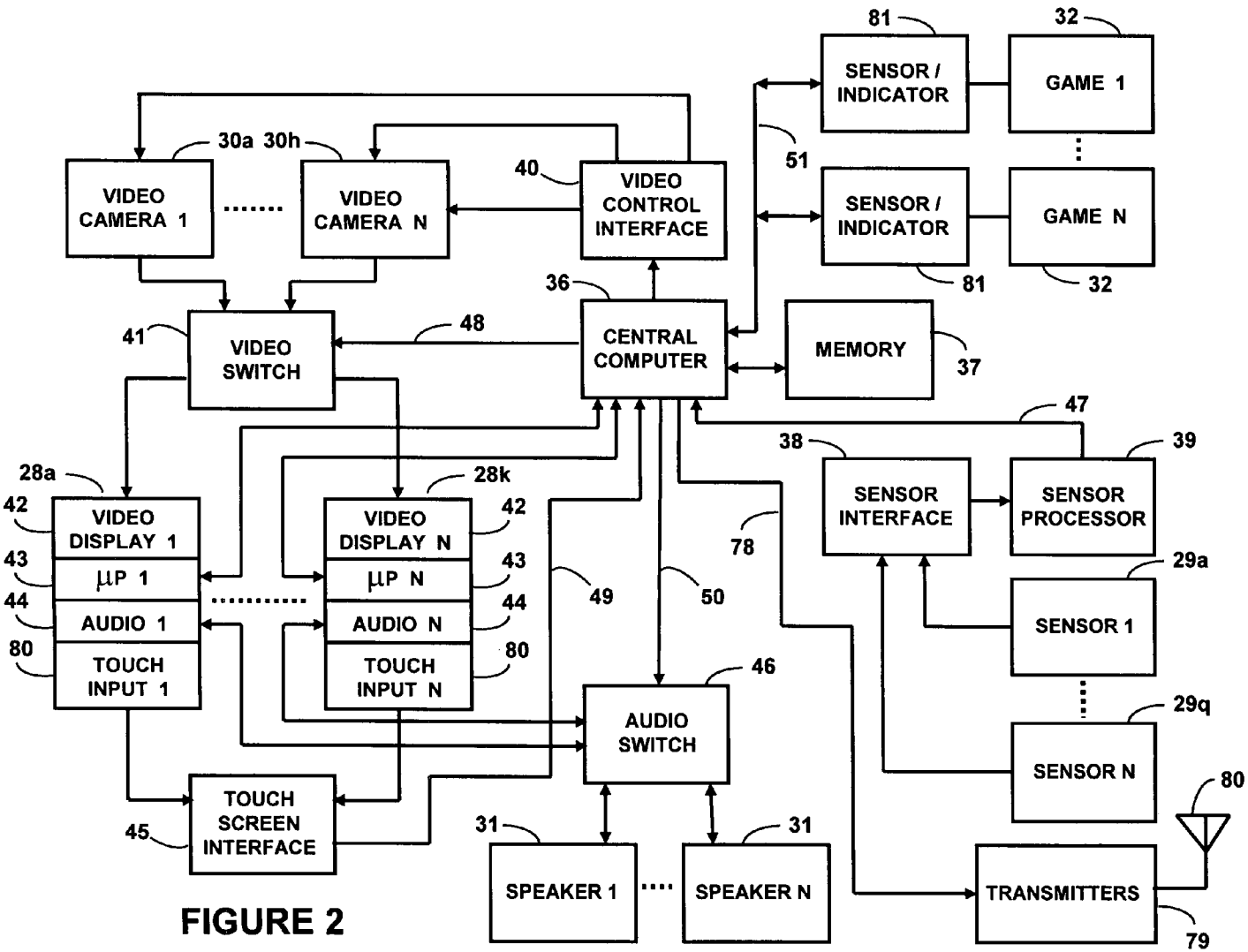
FIG. 2 shows a block diagram depicting a processor based system used to implement the present invention.

In FIG. 2 is shown a block diagram depicting a processor based system used to implement the present invention. Most of the operations of the security system shown in FIG. 2 are controlled by the aforementioned central computer 36 that is located in equipment room 33 of FIG. 1. As previously described, there are a plurality of touch screen video stations 28 (28*a*–28*k*) positioned on dining tables 26*a*–26*g* in dining area 12, at reception desk 23 (28*j*), office 20 (not shown), and kitchen 18 (28*k*). In FIG. 2 the plurality of video stations are represented by two monitors designated 28*a* and 28*k* with a series of dots between them. In addition, there is a plurality of sensors 29*a*–29*q* shown in FIG. 1 that are represented by two sensors designated 29*a* and 29*q* with a series of dots between them. Further, there is a plurality of video cameras 30*a*–30*j* shown in FIG. 1 that are represented in FIG. 2 by two video cameras 30*a* and 30*j* with a series of dots between them. Still further, there is a plurality of speakers 31*a*–31*h* shown in FIG. 1 which are represented in FIG. 2 by two speakers 31*a* and 31*h* with a series of dots between them. Finally, there is a plurality of games 32 in video game room 15 that are represented by two games Game 1 and Game N in FIG. 2. Games 32 are interconnected to central computer 36 via lead 51. All these elements are interconnected and controlled by the central computer as will now be described.

Sensors 29 in FIG. 2 are connected via a sensor interface 38 to a sensor processor 39 that processes the signals received from each child's ultrasonic transceiver 34 to first determine in which room a child is located, and then to triangulate the position of a child within a room. Ultrasonic signals are used instead of radio frequency signals because they will not pass through the walls in facility 10. This technology is well known in the prior art and is based on measuring the relative arrival times of the signals from each ultrasonic transceiver 34 at each of the ultrasonic sensors 29 located in a room in which a child is located. Each ultrasonic transceiver 34 transmits a signal within an assigned time slot that thereby distinguishes it from other transceivers 34. Sensor processor 39 is synchronized to the central computer clock so it can thereby determine which transceiver 34 a signal is received from. Sensor processor 39 forwards the identity and position information for each transceiver 34 via lead 47 to central computer 36 to be stored in memory 37. An alarm condition signals sent from ones of transceivers 34 are also sent to the central computer for appropriate action to be taken. When each child has an ultrasonic transceiver 34 attached to them at reception desk 23 upon registration, a unique identity for that transceiver 34 was entered via video station 28*j* to central computer 36 along with the child's name and table assignment. Central computer 36 matches the transceiver identity and position information received from sensor processor 39 with the initially stored information and thereby knows at all times the location of each child within facility 10. All this information is stored in memory 37.

More particularly, the system operates in a time division multiplex (TDM) manner wherein each child's transceiver 34 transmits its identification signal in a unique time slot assigned to each transceiver 34. There is no master clock to synchronize transceivers 34 with a clock in the central computer. Rather, a clock run by an oscillator in each transceiver 34 is set by the central computer just before the transceiver is attached to a child and the clock free runs until set again. The clock is accurate enough that while free running over several hours it maintains a close enough synchronization to a clock in the central computer and in a sensor processor associated with the ultrasonic sensors in each room so that each transceiver's periodic transmissions remain in their respective time slots.

Video cameras 30 are located throughout facility 10, as shown in FIG. 1. As previously described a parent or other person located at an assigned table 26 can use the touch screen capability of the video station 28 at their table 26 to initiate a viewing request to show a picture of their child on video station 28. The viewing request is forwarded to central computer 36 which looks up in memory 37 the room and specific location in the room the child of interest is located. This information was generated and stored as previously described. Using the location information central computer 36 identifies the video camera 30 in the room in which the child is located that will show the particular child. Computer 36 then sends a control signal via lead 48 to video switch 41 to switch the video output from the identified video camera 30 to the table 26 from which the viewing request originated. In addition, upon a request received from the particular table 26, computer 36 may accomplish an electronic zoom on the portion of the video picture from the video camera in which the child is shown to provide a close-up picture of the particular child.

When a child is located in a bathroom 16 or 17, in which there is no video camera 30, when a viewing request is received by central computer 36, a picture of the bathroom door is sent back to the video station 28 from where the viewing request originated. In addition, the name of the child and how long they have been in the bathroom are displayed on the screen with the picture of the bathroom door. If the parent, guardian or other responsible person thinks the child has been in the bathroom for an excessive length of time they may go check on them to make sure they are not sick or has other difficulties. Alternatively, if the central computer determines that a child has been in a bathroom more than a predetermined amount of time, an indication may automatically be sent to the child's assigned table.

Each video station 28 is comprised of a video display 42, a microprocessor 43, an audio portion 44, and touch input circuitry 80. Video display 42 is used to show video images sent from central computer 36, such as menus, billing and other information, pictures from a video camera 30, or video stations 28*j* or 28*k* forwarded via video switch 41. Microprocessor 43 is used with all the functions including the touch screen operation of video station 28 and determines where a person is touching the screen as an indication of a request. These requests are forwarded via touch screen interface 45 and lead 49 to central computer 36 that processes the requests accordingly. In addition, microprocessor 43 can run games that are played on a video station 28.

There are many types of requests and include, but are not limited to, menus, general facility information, food and drink ordering information, requests to see a picture of a child, and a request to send an oral message to a child. When a food and drink order has been prepared an Enter touch screen button is touched and the order is sent to central computer 36 which forwards the order to video station 28*k* in kitchen 18 were the order is prepared. If service staff is provided, when an order has been prepared they will deliver it to the particular table that placed the order. If no service staff is provided a visual and/or audible message is sent back to the video station 28 on the particular table that placed the order, and someone from that table picks up the food and drink order.

Audio portion 44 of each video station 28 serves two purposes. As described in the previous paragraph, if an audible message that a food and drink order is ready to be picked up is utilized, central computer 36 sends a control signal over lead 50 to audio switch 46 to forward the audible message to the audio portion 44 of the particular video station 28 from which the order was originated.

When a person at a particular video station 28 desires to send an audible message to a child, they touch an appropriate touch screen designation on video display 42. Responsive thereto microprocessor 43 sends a signal via touch screen interface 45 lead 49 to central computer 36. If the audible message (either page/buzzer or voice message) is sent to a transceiver 34 worn by a child the signal goes from audio switch 44 to central computer which causes a page signal or a short voice message signal to be forwarded over lead 78 to low power transmitters 79 which transmits their signals via antennas 80 to transceivers 34. As previously described, the pager and voice signals each have a coded address signal that is recognized only by selected ones of transceivers 34 in a manner well known in the art.

If the signal is a voice message to be sent to a speaker 31 in the play area in which the child is located, computer 36 is responsive to the request for audible message by looking up in memory 37 the location of the particular child as previously described. A signal is then sent by central computer 36 via lead 50 to audio switch 46 to establish a path between audio portion 44 of the particular video station 28 and a speaker 31 in the room in which the particular child is located. While the audio communication path is established a message indicating same is placed on video display 42. This audio connection is maintained for a short period such as five seconds, but this period may be longer or shorter.

This voice link capability may also be used when a food and drink order is being placed. When there are questions about food or drink items, or requests for special preparation, an appropriate touch screen location may be touched to establish a voice connection with kitchen personnel via video station 28*k*. Responsive to the audio link request central computer 36 sends control signals via control lead 50 to audio switch to establish a voice link between the audio portion 44 of video station 28*k* in kitchen 18 and the audio portion 44 of the particular video station 28 requesting the voice connection. Voice communication then takes place over the link until the appropriate touch screen location on the video station in the kitchen or on the table is touched again to terminate the voice link. As previously mentioned a video connection may also be established.

This audio operation is also used by the facility personnel for general paging purposes, and to communicate with particular tables, such as when a late arriving person wishes to enter and join a family or group already seated.

Games 32 may be played using the game credits obtained at reception desk 23, and game win credits are awarded by each game 32. The game win credits are redeemed at any time, including on departure from facility 10, for prizes at redemption center 21. In this automated operation, games 32 may be interconnected to central computer 36 via lead 51. As previously described, these games may be played by children who have been previously authorized to play same by receiving game credits. Sensors (not shown) are co-located with each game 32 and the presence of an ultrasonic transceiver 34 on a child standing in front of a machine and attempting to operate the game is detected. The identity of the ultrasonic transceiver 34 is returned to central computer 36 that checks for gaming authorization. If the child is authorized to play the game, and has remaining game credits, an enabling signal is returned to the particular game and the game is enabled to be played. In addition, the pre-authorized number of games credits is decremented, and win credits are accumulated by computer 36. As previously described, upon registration, or thereafter, the child may receive a number game credits set by their parent, guardian or other to play a certain number of game plays, and each time the child plays any game it is deducted from their game credits.

When the family finishes their stay in dining and entertainment facility 10 they may access their bill by touching the appropriate spot on touch screen enabled video station 28*b* or 28*c*. They will then go to reception desk 23, pay their bill, redeem any prizes, and have the ultrasonic transceivers removed from their children. Located on each table 26 and/or at reception desk 23 may be a card swipe mechanism (not shown) for using credit or debit cards to pay bills.

As part of the checking out process the personnel at reception desk 23 compare the photograph of the group taken on registration with the group leaving to assure that an unauthorized person or persons are not attempting to leave with a child or children, and that all people are leaving. If this does happen exit gate 24 is locked, not opened and the authorities may be called and/or the proper authorized persons paged to come to reception desk 23. The gate opening operation is designed so that a button must be held down by personnel at reception desk 23 the entire time the gate is unlocked. If the button is released the gate immediately re-locks. This prevents an unauthorized person from pushing the button and attempting to exit through gate 24 before it re-locks.

Figure 3:
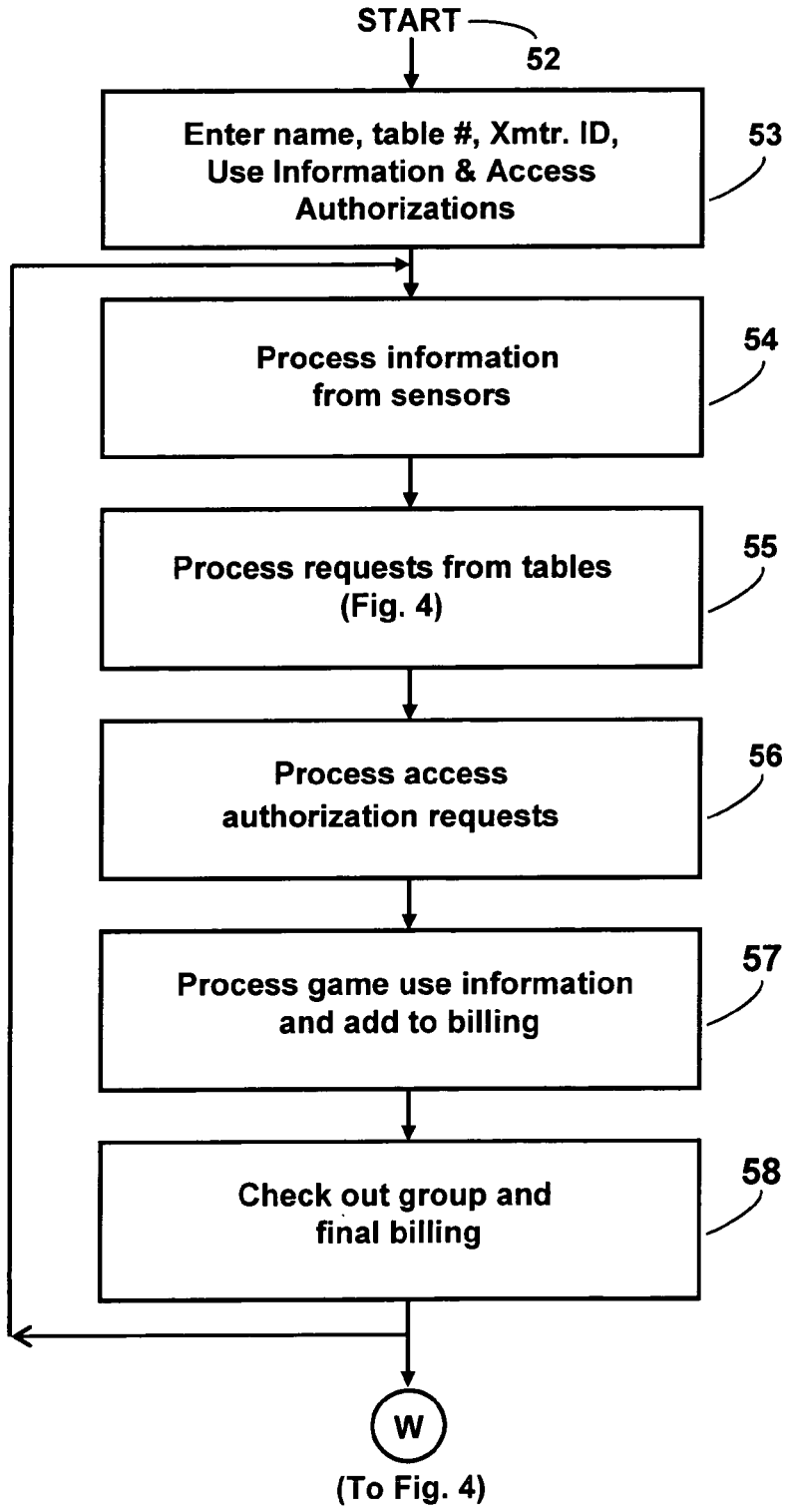
FIG. 3 is a flow chart depicting the logic involved in the software running a processor in the processor based system used to implement the present invention.

In FIG. 3 is shown a flow chart of the program running on central computer 36 in FIG. 2 to implement the preferred embodiment of the present invention. The program starts at block 52. The first step in the operation is accomplished at block 53 where personnel at reception desk 23 enter information into the supervised child monitoring system using video station 28*j*. The name of each member of a group is entered, their assigned table number is entered, the identification number of the ultrasonic transceivers 34 attached to specific named children of the group is entered, access authorization to particular ones of play areas 13, 14 and 15 is entered for specific ones of the children of the group, and game credits indicating the number of games that each child may play in video game play area 15 is entered.

At block 54 the program stores child location information received from ultrasonic sensor processor 39. The location information is determined by a sensor processor 39 from signals received from ultrasonic transceivers 29*a–s* as previously described with reference to FIG. 2, and the child location information is stored in memory 37 for use in operations as previously described.

At block 55 the program processes service requests sent from customer tables 26*a–g*, reception desk 23 and kitchen 18 using video stations 28*a–k*. These service requests include sending food and drink orders to kitchen 18; providing audio communications between tables 26*a–g* to play areas 13, 14 & 15, kitchen 18 and reception desk 23; providing video access to view children in play areas 13, 14 & 15; and displaying cumulative billing information at video stations 28*a–j*.

At block 56 the program processes access authorization requests. These access authorization requests are generated by a child wearing an ultrasonic transceiver 34 walking up to the door or gate 35*a–c* of one of play areas where the distinctive ultrasonic identification signal generated by the child's ultrasonic transceiver 34 is detected by an ultrasonic receiver and sent to central computer 36 (FIG. 2) located in equipment room 33 to determine if the child has been authorized by their parent or guardian to enter the play area. If authorization has been previously granted a signal is returned to the particular door or gate 35*a–c* to unlock the door or gate and permit the child access to the play area. If access has not been previously granted the door or gate 35*a–c* remains locked.

At block 57 the program processes video game 32 use information and adds it to the billing information for the group to which a child playing a game is a member. When a child wearing an ultrasonic transceiver 34 walks up to one of video games 32 in play area 15 to play same, the distinctive ultrasonic identification signal generated by their ultrasonic transceiver 34 is detected by a sensor at each game (not shown) and sent to central computer 36 (FIG. 2) which keeps track that the child played the game and deducts it from their game credits previously authorized. With this automated game control operation, winnings earned at games 32 in play area 15 are collected by computer 36 and stored in memory with reference to the particular child who later may pick up their prizes at redemption center 21.

At block 58 the program receives information from personnel at reception desk 23 using video station 28*j* to check out a departing family or group and provide final billing information for payment by cash or credit card. At this time ultrasonic transceivers 34 are removed from the children. Un-redeemed game winnings are read out of memory and the children may select their prizes at redemption center 21. All information regarding the group is removed from central computer 36 in FIG. 2, except as may be saved for archive purposes.

Figure 4:
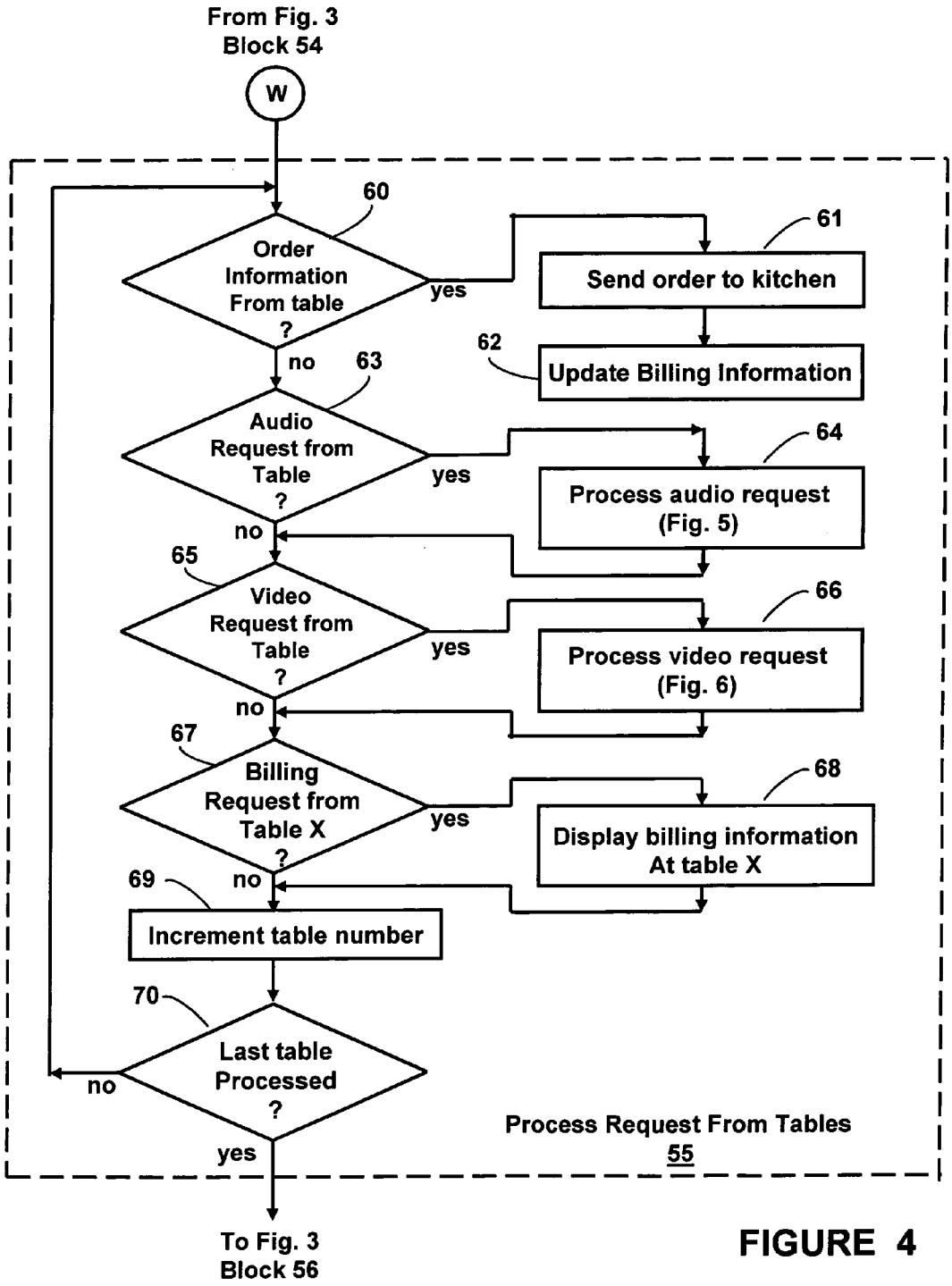
FIG. 4 is a flow chart showing more detail of a portion of the flow chart in FIG. 3.

In FIG. 4 is shown a flow chart having more detail of block 55, Process Requests From Tables flow chart shown in FIG. 3. Accordingly, the input to FIG. 4 is from block 54 in FIG. 3, and the output from FIG. 4 is to block 56 in FIG. 3. The first step in this flow chart is decision block 60 where the computer checks if food and drink ordering information is being sent from table 26*a*–table 26*g*. If the decision answer is yes, the order is retrieved from video station 28*a* on table 26*a* and forwarded to kitchen 18 at block 61 where the food and drink order is displayed on kitchen video station 28*k* for order fulfillment. The program then progresses to block 62 to update billing information for the group at table 26*a*. If the decision answer is no, and/or after the billing information is updated, the program progresses to block 63 to process audio requests.

At decision block 63 the program causes central computer 36 to check if there is an audio request from table 26*a*. This audio request may be implemented at table 26*a* if it is desired to talk with kitchen personnel about a food and drink order, to talk with children of the family or group assigned to table 26*a* who are playing in ones of play area 13, 14 & 15, and to talk to personnel at reception desk 23. In the first instance the audio request is made at the time food and drink ordering information is being sent to kitchen 18. In the second instance the audio request is made using a specific touch screen button indicating a request for an audio link to a child. In the third instance the audio request is made using a specific touch screen button indicating a request for an audio link to reception desk 23. When the decision made at block 63 is yes, the program progresses to block 64 where the audio request is processed to establish the requested audio link. The steps performed in block 64 are described in greater detail with reference to FIG. 5. After an audio request is fulfilled, the program progresses to block 65. If the decision at block 63 is no, the program also progresses to block 65 to check for a video viewing request from table 26*a*.

Block 65 is a decision block whereat central computer 36 in FIG. 2 checks to determine if there is a video viewing request from table 26*a* (table X). When the answer is yes, central computer 36 progresses to block 66 where the program running in the central computer processes the video viewing request to establish the requested video link. The steps performed in block 66 are described in greater detail with reference to FIG. 5. After the video request has been fulfilled at block 66, or if the decision at block 65 is no, the program progresses to block 67 to determine if there is a request for billing information from table 26*a*.

Block 67 is a decision block whereat central computer 36 in FIG. 2 checks to determine if there is a request from table 26a for cumulative billing information. When the decision answer is yes, the program progresses to block 68 whereat central computer 36 retrieves the cumulative billing information for table 26*a* from memory 37 and forwards it to be displayed on video station 28*a* at table 26*a*. After the billing information is displayed, or if the decision answer is no, the program progresses to block 69 where the table number X is incremented and the next table, table 26*b*, is indicated and processed as described in the previous paragraphs.

The program then progresses to decision block 70 where it is determined if all tables have been processed. If the decision answer is no, the program loops back to block 60 to repeat the above described operations, but now for table 26*b*. This loop back repeats through the tables until the last table 26*g* has been processed. At that time the output from decision block 70 is yes and the program progresses to block 56 in FIG. 3 to process access authorization requests.

Figure 5:
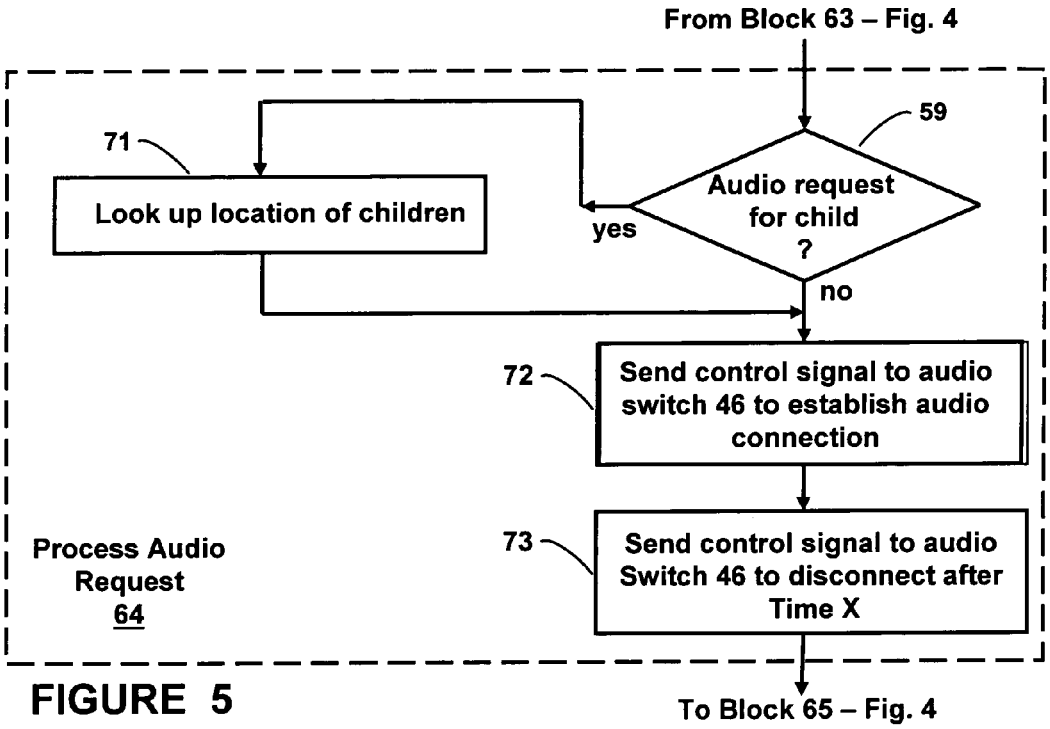
FIG. 5 is a flow chart showing more detail of a portion of the flow chart in FIG. 4.

In FIG. 5 is shown a flow chart having more detail of block 64 in FIG. 4. Block 64 processes audio requests as previously mentioned. The first step in block 64 is decision block 59 whereat it is first determined if the audio request is to talk to a child. If the decision answer is yes, the program progresses to block 71 where computer 36 looks up from memory 37 the physical location in facility 10 of each child assigned to table 26*a*. The child location information is required when an audio link is being requested to a child. When the decision answer is no, or after child location information has been read out of memory 37, the program progresses to block 72 where control signals are sent to audio switch 46 by computer 36 to establish an audio communication link between table 26*a* and the requested location, or the location where a child is at. If the requested location is reception desk 23, the audio link is established thereto. If the audio link has been requested to kitchen 18, the audio link is established to a speaker in the kitchen. If an audio link had been requested to a child, the computer uses the child location information to establish the audio link to the particular play area 13, 14 or 15, to a bathroom 16 or 17, or to a speaker within dining area 12 closest to the child. The audio link is left established for a short period, such as five seconds, to permit sending an audio message to the child, and at block 73 the audio link is then disconnected. The program then returns to block 65 in FIG. 4. If the audible connection to a child is not via a speaker in a play area, the communication is transmitted to the transceiver 34 worn by a child.

Figure 6:
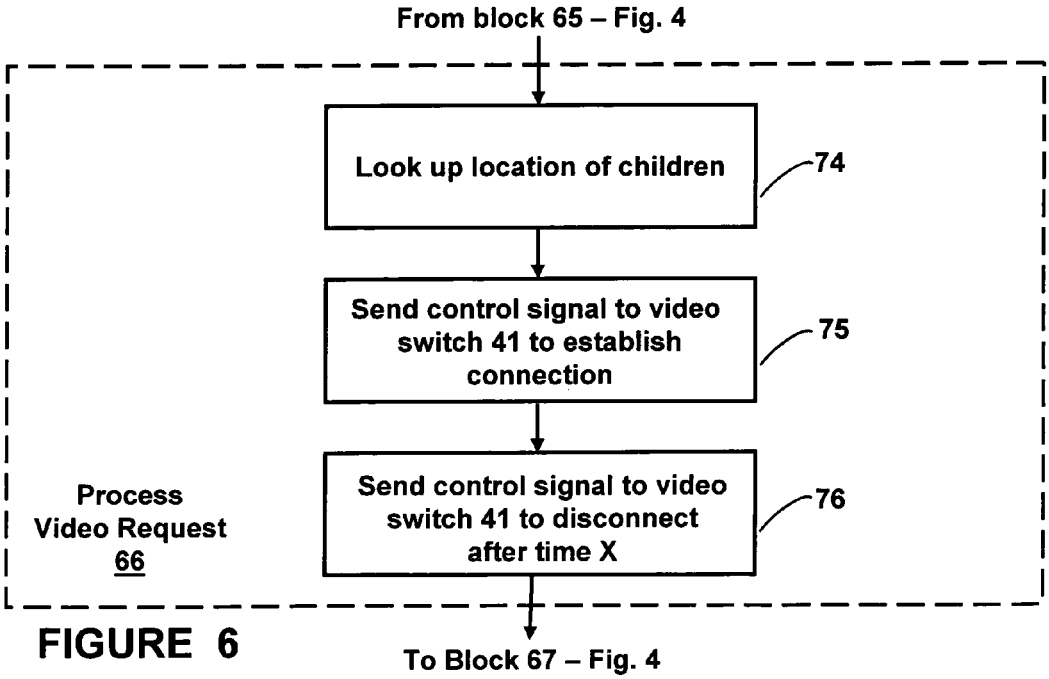
FIG. 6 is a flow chart showing more detail of a portion of the flow chart in FIG. 5.

In FIG. 6 is shown a flow chart having more detail of block 66 in FIG. 4. Block 66 processes video viewing requests as previously mentioned. The first step at block 74 is to look up the location of the children assigned to table 26*a* by reading out the child location information stored in memory 37. Using this information central computer 36 in FIG. 2 sends a control signal to video switch 41 to establish a video link connection between video station 28*a* on table 26*a* and a video camera 30 located nearest to each child and which shows the child. If the first child, wearing ultrasonic transceiver 34*a*, is in play area 13, as shown in FIG. 1, and the video signal from video camera 30*e* is connected to video station 28*a* on table 26*a*. The second child, wearing ultrasonic transceiver 34*b*, is in play area 14, as shown in FIG. 1, and the video signal from video camera 30*g* is connected to video station 28*a* on table 26*a*. As previously mentioned, when there is more than one child in the group the computer will create a screen operation on video station 28*a* in a manner well known in the video art. Alternatively, ones of the split screens may be selected and displayed as full screen pictures. The program then progresses to block 67 in FIG. 4.

Figure 7:
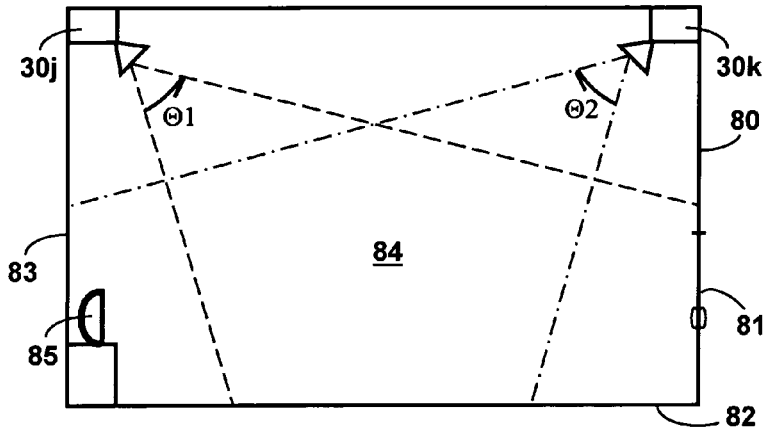
FIG. 7 is a side view of a room and the angles of view of video cameras in the room.

In FIG. 7 is shown a side view of a room 84 and the angle of view of video cameras 30*j* and 30*k* within the room. The angle of view of camera 30*j* is shown as the two dashed lines from that camera, and the angle of view of camera 30*k* is shown as the two dash-dot lines from that camera. It can be seen that neither video camera 30*j* or 30*k* can provide an image of the entire room. For example, video camera 30*j* cannot image items below it, such as video game 85, but video game 85 can be seen by camera 30*k*. Also, video camera 30*k* cannot image items below it, such as door 81, but door 81 can be seen by camera 30*j*. Together cameras 30*j* and 30*k* can image the entire floor area 82 inside room 84 and, therefore, any child inside room 84 is in the view of one or both of cameras 30*j* and 30*k*. For example, when a child is near door 81 video camera 30*j* is used to provide a video image of the child on the screen of video terminal 28 at the table to which the child is assigned. Conversely, if the child is at video game 85 in room 84 shown in FIG. 7, video camera 30*k* is used to provide a video image of the child on the screen of video terminal 28 at the table to which the child is assigned. In some instances more than two video cameras 30 may be required to provide images of all portion of a room.

Figure 8:
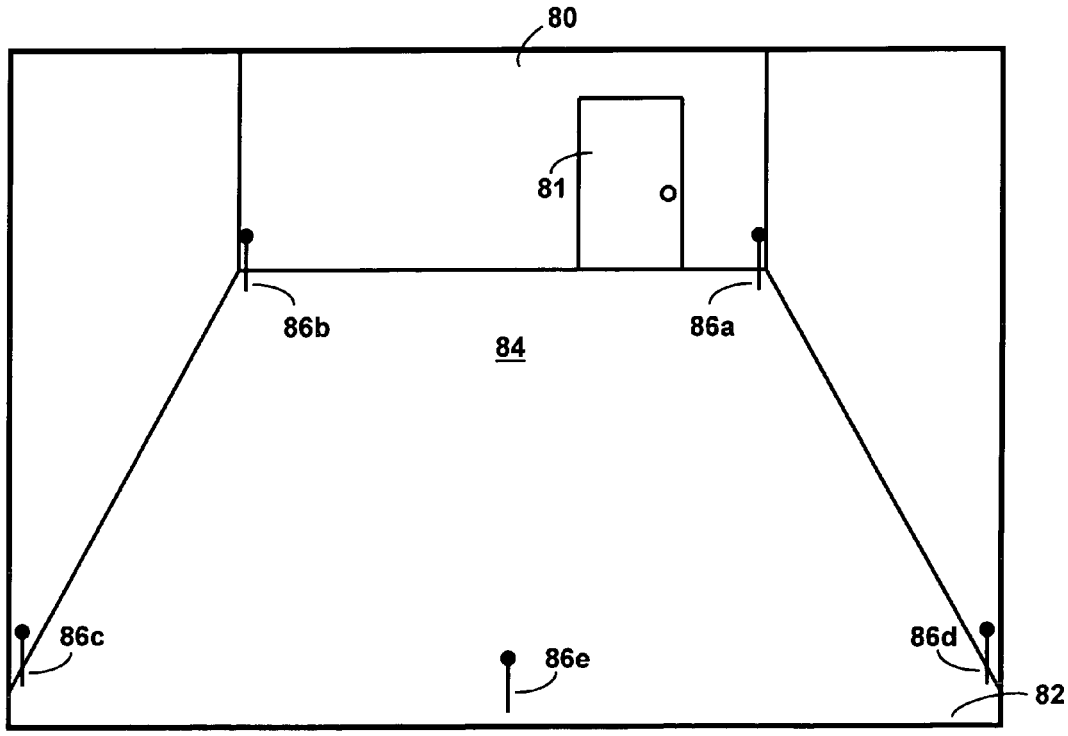
FIG. 8 shows the view of one video camera in a room during system setup.
Figure 9:
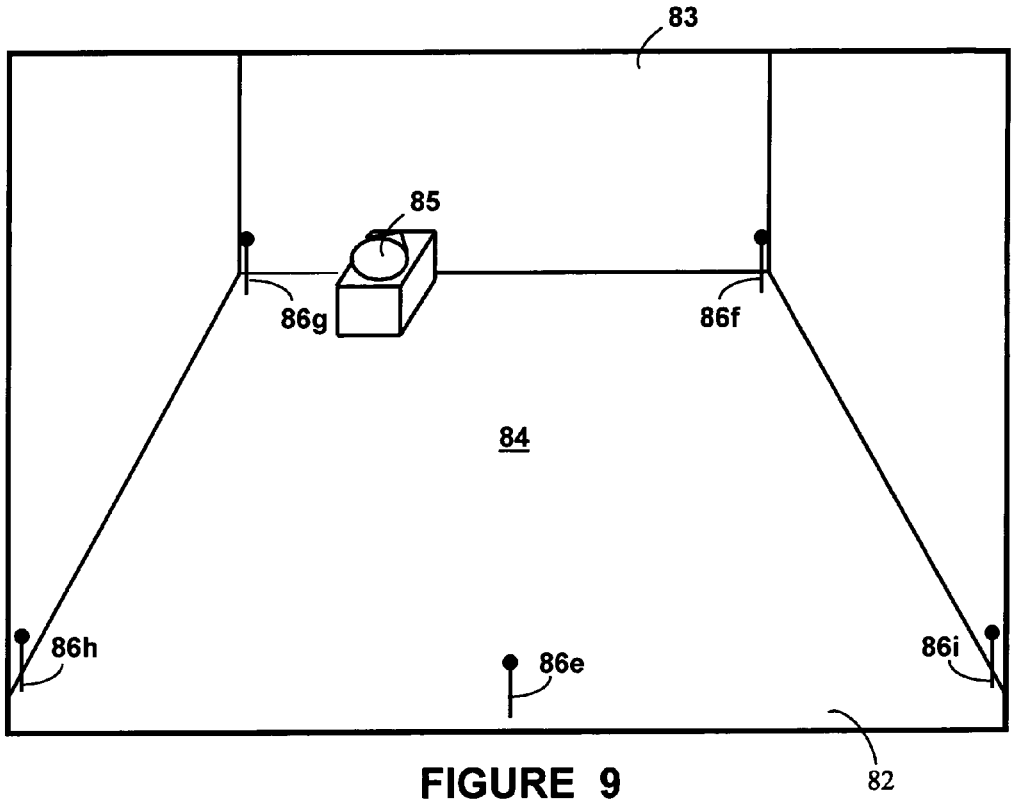
FIG. 9 shows the view of a second video camera in the same room during system setup.

FIG. 8 shows the video image output from video camera 30*j* and FIG. 9 shows the video image output from video camera 30*k*. More particularly, camera 30*j* has door 81 within its view as seen in FIG. 7, and the door 81 is seen in the video image in FIG. 8. Similarly, camera 30*k* has game 85 within its view as seen in FIG. 7, and the game is seen in the video image in FIG. 9. Together cameras 30*j* and 30*k* can image the entire floor area 82 inside room 84 and all items and people in the room.

It is necessary to calibrate the ultrasonic signal processing equipment (not shown) in equipment room 35 (FIG. 1) using the video cameras 30 and the ultrasonic receivers 29 in each room (not shown in FIGS. 7, 8 & 9). This done by mapping the view of all cameras 30 in a room with physical locations in the same room as determined by the ultrasonic signal processing equipment checking physical coordinates of ultrasonic transmitters in the room. This is done in order for: (1) the system to determine which video cameras 30 in a room a child is in view of, and (2) to determine which video camera 30 in a room should be used to show a video picture of a child and which camera should be used when electronic zoom is to be accomplished. To perform this calibration one person sits at a touch screen equipped video station 28 while another person is inside a room that is to be calibrated. The two people are in voice communication with each other during the calibration process. The person inside room 84 has a rod about 2 feet tall with an ultrasonic transceiver 34 affixed to the top. This is shown as calibration tool 86 in both FIGS. 8 and 9. Tool 86 is meant to simulate a child wearing a waist mounted transceiver 34 playing inside room 84. Although not shown in FIGS. 8 & 9, room 84 would contain recreational equipment to be enjoyed by children playing in the room.

With reference to FIG. 8, the person inside room 84 with calibration tool 86 first stands tool 86 in the corner nearest door 81 as shown at 86*a*. The person at video station 28 touches the screen at the top of tool 86. The touch screen circuitry provides a signal to the central computer (not shown) in equipment room 33 indicating the screen location of tool 86. At the same time there is a signal output from the ultrasonic sensor signal processor (not shown) that processes ultrasonic signals received from the ultrasonic transceiver 34 on the top of tool 86 and provides physical location information to the central computer. In this manner there is a correlation of the physical location of a transceiver 34 to a position on the screen of video station 28.

The person inside room 84 then moves to the furthest corner on the wall in which is door 81 and stands calibration tool 86 as shown at 86*b*. The person at video station 28 again touches the screen at the top of tool 86. The process described in the previous paragraph is repeated and the central computer again has a correlation of a transceiver 34 in this corner of room 84 to a position on the screen of video station 28.

While in voice communication with the person at video station 28, the person in room 84 moves along the wall toward the video camera (not shown in FIG. 8) until they are at the edge of the video screen as shown with the tool at 86*c*. The above correlation process is repeated and stored by the central computer. The person in the room then moves to the opposite wall and, while in voice communication with the person at video station 28, moves along the wall toward the video camera until they are again at the edge of the video screen as shown with the tool at 86*d*. The above described correlation processes is repeated and stored. The person in room 84 then moves to the middle of the room to stand the tool at 86*e* when they are at the bottom edge of the video station screen. The above described correlation process is again repeated and stored.

Video camera 30*k* that generates the image in FIG. 9 must then be calibrated in the same manner as just described with reference to FIG. 8. While in voice communication with the person at video station 28, the person in room 84 places calibration tool 86 at positions 86*f*, 86*g*, 86*h*, 86*i*, and 86*j* while the person at the video station 28 touches the screen for each position.

The above described process must be repeated with the zoom settings of each camera at different settings. This must be done because the ultrasonic signal processing equipment (not shown) in equipment room 35 (FIG. 1) will have different mappings of physical three dimensional coordinates in a room with video screen locations for different camera zoom settings.

With this calibration process completed, when a child wearing an ultrasonic transceiver is in room 84, or in any other room in which calibration has been accomplished, the central computer receives location information for the child from the ultrasonic sensor signal processor and can thereby first determine which of cameras 30*j* and 30*k* the child is in view of, or best in view of, and can then determine where in a video image output from the selected camera the child is located. This latter information is necessary when a close-up of the child is being generated by an electronic zoom process that is well known to the art. The computer uses the stored correlation information and interpolates where in the video picture from the chosen video camera 30 the child is located.

While what has been hereinabove is the preferred embodiment of the invention, it will understood by those skilled in the art that numerous changes may be made without departing from the spirit and scope of the invention. For one example, a small transmitter may be attached to each item in a warehouse and the signal from the transmitter used to physically locate the associated items, or to sound an alarm and take other actions if items are removed from their assigned locations without previous authorization. Alternatively, a transmitter may be attached to personnel in a highly hazardous area or a high security area. A transceiver may used instead if it desired to send a signal to a specific transceiver to cause an audio signal to be generated that can be used in locating a specific item.

The invention claimed is:

1. A system for monitoring the location of and providing security for persons in a facility having entrances at which ingress to and egress from said facility is controlled, said monitoring system comprising:

a plurality of first transmitters, one of said first transmitters being assigned and attached to each person to be monitored and tracked within said facility, each of said first transmitters transmitting a unique identification signal;

a plurality of first receivers placed around said facility for receiving said unique identification signals transmitted by ones of said first transmitters;

a second receiver being located with each of the plurality of first transmitters;

means associated with said plurality of first receivers for processing said identification signals received by multiple ones of said first receivers to locate and store the physical location of said persons in said facility;

a plurality of video cameras placed around inside said facility, each video camera providing a video output signal showing a portion of the interior of said facility in its view;

a plurality of communication stations distributed around said facility;

at least one video display with each of the plurality of communication stations;

a second transmitter for transmitting signals to ones of the second receivers, wherein said second transmitter can be enabled from ones of said communication stations to send a signal to selected ones of said second receivers; and said processing means determining which video camera has each person in its view in order to provide a video image of any specific person on said video display when requested.

2. The system in accordance with claim 1 wherein each of said first transmitters transmits a unique trouble signal if it is either removed in an unauthorized manner from its assigned person or it ceases periodically transmitting its unique identification signal.

3. The system in accordance with claim 2 wherein said processing means processes said unique trouble signals and causes an alarm to be sounded when a first transmitter is either removed in an unauthorized manner from its assigned person or it ceases periodically transmitting its unique identification signal, and causes the video output signal from the one of said video cameras showing a person with a first transmitter that generated a unique trouble signal to be forwarded to and displayed on the video display of specific ones of said communication stations.

4. The system in accordance with claim 3 wherein one of the communication stations is provided in proximity to each of said entrances where said persons will enter and exit said facility to enter data to said processing means regarding said last mentioned persons and said first transmitters assigned thereto.

5. The system in accordance with claim 4 wherein said facility has a plurality of rooms therein, ones of said rooms has a gate for controlling ingress thereto, information is input to said processing means via said communications stations indicating which of said plurality of rooms with gates each person may be in, and further comprising:

a second receiver adjacent to each of said gates for receiving said unique identification signal from a first transmitter on a person that is positioned before a second receiver, said second receivers sending said last mentioned unique identification signals to said processing means to determine if the person to which the first transmitter is attached and before a gate is authorized to be in a room.

6. The system in accordance with claim 3 further comprising control means at each of said entrances at which ingress to and egress from said facility is controlled, all said control means being responsive to said processing means to lock their associated entrances when either a first transmitter is removed in an unauthorized manner from its assigned person or it ceases transmitting its unique identification signal and the unique trouble signal is generated.

7. The system in accordance with claim 1 further comprising control means at each of said entrances at which ingress to and egress from said facility is controlled, all said control means being responsive to said processing means to lock their associated entrances when a first transmitter is removed in an unauthorized manner from its assigned person.

8. The system in accordance with claim 1 wherein said facility has a plurality of rooms, ones of said rooms has a gate for controlling ingress thereto, information is input to said processing means via said communications stations indicating which of said plurality of rooms with gates each person may be in, and further comprising:

a second receiver adjacent to each of said gates for receiving said unique identification signal from a first transmitter on a person that is positioned before a second receiver, said second receivers sending said last mentioned unique identification signals to said processing means to determine if the person to which the first transmitter is attached and before a gate is authorized to be in a room.

9. The system in accordance with claim 1 wherein one of the communication station is provided in proximity to each of said entrances where persons will enter and exit the facility to enter data to the processing means regarding the last mentioned persons and the first transmitters that are attached to them.

10. The system in accordance with claim 1 wherein said processing means generates an alarm signal if said first transmitter attached to one of the persons ceases transmitting its unique identification signal.

11. A system for monitoring the location of, and providing security for, children in a play facility having entrances at which ingress to and egress from said facility is controlled by facility personnel, said monitoring system comprising:

a first transmitter assigned and attached to each child to be monitored and tracked within said facility, each of said first transmitters periodically transmitting a unique identification signal;

a plurality of receivers placed around said facility for receiving said unique identification signals transmitted by said first transmitters;

means associated with said plurality of receivers for processing said unique identification signals received by said receivers to locate the physical position of each child in said facility to which a first transmitter is attached; a plurality of video cameras placed inside said facility, each video camera providing a video output signal showing a portion of the interior of said facility;

a plurality of video displays;

the processing means storing the physical location of each child and determining which video camera has each child in its view in order to provide a video image of each child on specific ones of said video displays, and when a first transmitter is either removed in an unauthorized manner from a child or ceases transmitting, the processing means causes the video output signal from the one of the video cameras showing the child with the last mentioned first transmitter to automatically be forwarded to and displayed on specific ones of the video display.

12. The system in accordance with claim 11 further comprising a communication station located with each said video display, and upon a request being placed from a communication station to display the video image of a selected one of said children playing in said facility on its associated video display, said processing means causes the video output signal from a one of said video cameras with said last mentioned child in its view to be forwarded to and displayed on said last mentioned video display.

13. The system in accordance with claim 12 wherein each of said first transmitters transmits a unique trouble signal if it is either removed in an unauthorized manner from the child to which it is attached, or it ceases transmitting its unique identification signal.

14. The system in accordance with claim 13 wherein said processing means processes said unique trouble signals and causes an alarm to be given when either a first transmitter is removed in an unauthorized manner from a child or ceases transmitting its unique identification signal, which causes the video output signal from the one of said video cameras showing the child with said last mentioned first transmitter to automatically be forwarded to and displayed on the video display associated with specific ones of said communication stations.

15. The system in accordance with claim 13 wherein one of said communication stations are provided in proximity to each of said entrances where a child will enter said facility to enter data to said processing means regarding said last mentioned child and one of said first transmitters that is attached to them.

16. The system in accordance with claim 15 wherein said facility has a plurality of rooms therein, ones of said rooms has a gate for controlling entrance thereto, information is input to said processing means via said communications stations indicating which of said plurality of rooms with gates each child may enter, and further comprising:

a second receiver adjacent to each of said gates for receiving said unique identification signal from a first transmitter that is positioned before a second receiver, said second receivers sending said last mentioned unique identification signals to said processing means to determine if the child to which a first transmitter is attached and before a second receiver is authorized to enter a room.

17. The system in accordance with claim 13 further comprising control means at each of said entrances at which ingress to and egress from said facility is controlled, all said control means being responsive to said processing means to lock their associated entrances when either a first transmitter is removed in an unauthorized manner from a child or it ceases transmitting its unique identification signal.

18. The system in accordance with claim 11 wherein each of said first transmitters transmits a unique trouble signal when it is either removed in an unauthorized manner from the child to which it is attached or it ceases transmitting its unique identification signal.

19. The system in accordance with claim 18 further comprising control means at each of said entrances at which ingress to and egress from said facility is controlled, all said control means being responsive to said processing means to lock their associated entrances when a first transmitter is either removed in an unauthorized manner from a child or it ceases transmitting its unique identification signal.

20. The system in accordance with claim 11 wherein one of communication stations are provided in proximity to each of said entrances where a child will enter said facility to enter data to said processing means regarding said last mentioned child and one of said first transmitters that is attached to them.

21. The system in accordance with claim 11 further comprising:

a second receiver associated with each of said first transmitters;

a second transmitter, said second transmitter for transmitting signals to ones of said second receivers.

22. The system in accordance with claim 21 further comprising a plurality of communication stations distributed, about said facility, wherein said second transmitter can be enabled from ones of said communication stations to send a signal to selected ones of said second receivers.

23. A method for monitoring and tracking the location of, and providing security for, children with their parent(s) or guardians(s) in a play facility having entrances at which ingress to and egress from the facility is controlled at first gates that are selectively controlled by restaurant personnel, and said facility has a plurality of tables to which groups including children are assigned, said method comprising the steps of:

attaching a transceiver to each child who is to be monitored and tracked within said facility, each transceiver periodically transmitting a unique identification signal, each said transceiver transmitting a unique trouble signal if it is either removed in an unauthorized manner from the child to whom it is attached or it ceases transmitting its unique identification signal;

receiving the unique identification signal transmitted by each transceiver;

locating the position of each child in the facility using the unique identification signal transmitted by each transceiver;

taking a picture of each child and their parent(s) or guardians(s) when they enter the facility and comparing that picture with the child and whomever they are with when exiting the facility to assure that an unauthorized person or persons are not attempting to leave with the child; and blocking egress from said facility when said unique trouble signal is received from any transceiver until said child wearing the transceiver that sent the last mentioned unique trouble signal can be located.

24. The method in accordance with claim 23 wherein said facility has playrooms for the children to play in, and each group table in said facility has a communications terminal with video display, and further comprising the steps of:

monitoring the activity of children in the facility using one or more video cameras;

determining which video camera in said facility has each child in its viewing area using the located position of each child;

displaying the video output from a video camera on the video display of a communications terminal from which a request has been generated to show a picture of a child in the group assigned to the table on which is located the last mentioned communications terminal.

25. The method in accordance with claim 24 further comprising the step of blocking egress from said facility when it is sensed that the transceiver attached to a child has either been removed in an unauthorized manner or it ceases transmitting its unique identification signal.

26. The method in accordance with claim 25 wherein ones of said playrooms have a gate for controlling ingress to the playroom, and further comprising the steps of:

determining if a child approaching a gate to a playroom is authorized to enter the playroom; and opening the gate to the last mentioned playroom if a child is authorized to enter the playroom.

27. The method in accordance with claim 26 wherein at least one of said playrooms has video games therein, and further comprising the steps of:

assigning game play credits to a child to play said video games;

determining if a child approaching a video game has sufficient game play credits to play said last mentioned video game; and enabling said last mentioned video game to be played if the last mentioned child has sufficient game play credits to play the game.

28. In a computer controlled system for monitoring the location of persons in a facility having video displays, and video cameras located throughout the facility that provide video signals to the video displays, and the persons each have a transmitter attached to them and each transmitter transmits a unique identification signal that is tracked by location monitoring equipment, a method for correlating the position of the persons as determined by the location monitoring equipment with images seen on the video displays so that as persons are selected to be viewed they may be shown on the video monitors, said method comprising the steps of:

sequentially positioning one of said transmitters in different physical positions in the viewing area of each of said video cameras;

indicating to said computer controlled system where said one of said transmitters is shown on a video display for each of said different physical positions; and storing the information of transmitter position and corresponding video display location for each of said video cameras, said stored information being used by said computer controlled system to determine which of said plurality of video cameras has each person with transmitter in its view, and when there is a request to display a particular person on a selected video display the video signal output from the proper video camera is displayed thereon.

29. The method in accordance with claim 28 further comprising the step of determining which video camera has a better view of a person with a transmitter when said last mentioned person is in view of more than one video camera, and sending the video signal from the video camera having the better view of said particular person to be displayed on the selected video display.

* * * * *